US006925947B2

(12) United States Patent
Lin et al.

(10) Patent No.: US 6,925,947 B2
(45) Date of Patent: Aug. 9, 2005

(54) PROCESS AND CONFIGURATION OF MULTILAYER PROTRUDING EMBROIDERY

(76) Inventors: Chien-Lu Lin, 28, Tunnel 239, Chiu Ju 1 Road, Kaohsiung (TW); Ming-Chin Chou, 27, Tunnel 239, Chiu Ju 1 Road, Kaohsiung (TW)

( * ) Notice: Subject to any disclaimer, the term of this patent is extended or adjusted under 35 U.S.C. 154(b) by 0 days.

(21) Appl. No.: 10/843,344

(22) Filed: May 12, 2004

(65) Prior Publication Data

US 2004/0226497 A1 Nov. 18, 2004

(30) Foreign Application Priority Data

May 14, 2003 (CN) ..... 092113268

(51) Int. Cl.[7] ..... D05C 17/00
(52) U.S. Cl. ..... 112/475.22; 112/439
(58) Field of Search ..... 112/475.18, 475.21, 112/475.22, 475.23, 439, 441; 2/244; 28/163, 164

(56) References Cited

U.S. PATENT DOCUMENTS 924,795 A * 6/1909 Klemm et al. ..... 112/475.22
5,111,760 A * 5/1992 Garzone, Jr. ..... 112/439
5,399,410 A * 3/1995 Urase et al. ..... 428/102
6,101,962 A * 8/2000 Hinshaw ..... 112/475.22
6,164,228 A * 12/2000 Lin et al. ..... 112/475.22
6,263,817 B1 * 7/2001 Tajima et al. ..... 112/475.22

* cited by examiner

*Primary Examiner*—Ismael Izaguirre
(74) *Attorney, Agent, or Firm*—Bacon & Thomas PLLC

(57) ABSTRACT

A multilayer protruding embroidery process including the steps of laying and affixing a first filler on an embroidery background element; entirely wrapping up an embroidery portion of the first filler and the embroidering background element with a plurality of first sewing threads. Laying and affixing a second filler on the first and entirely wrapping up an embroidery portion including a side periphery of the second filler and background with a plurality of second embroidery threads. Fully cutting off and removing the leftover of the second embroidery portion and the first embroidery portion respectively, wherein said second portion is and outer portion of the second filler surrounding said embroidery portion, and the first embroidery portion is an outer portion of the first filler surrounding the first embroidery portion and thus a multilayer protruding embroidery is produced.

6 Claims, 2 Drawing Sheets

PROCESS AND CONFIGURATION OF MULTILAYER PROTRUDING EMBROIDERY

FIELD OF THE PRESENT INVENTION

The present invention relates to embroidery, and more particularly to a process and configuration of multilayer protruding embroidery which is adequate for mass production.

BACKGROUND OF THE PRESENT INVENTION

A conventional method of embroidery an embroidery with protruding figures is to provide a plurality of overlapped layers of thread. Embroidery machine embroiders a small draft as a bottom layer on a cloth or silk background element which can be processed to a quiet cover, floss silk, shoe, or a baseball cap. The background element is gradually embroidered layer by layer until a predetermined thickness of the thread layers is achieved so as to provide a protruding figure on the background element.

However, the conventional embroidering method and embroidery configurations have the following drawbacks:

(1) It can only produce a slightly protruded embroidery which is gradually raised from the edge of the embroidered figure to form a thickness of not more than 2.5 mm (2 mm to 2.5 mm) at the central portion.

(2) Since the protruded embroidery is formed with many layers of thread, it utilizes a great amount of threads and increases the cost and embroidering time. Moreover, the quality achieved is not smooth and solid enough.

(3) Many needle holes are formed on the background element that will weaken the duration and reduce the strength of the embroidery product.

As my U.S. Pat. Nos. 5,832,854, 5,947,044 and 6,164,228 are discloses the protruding embroidery with single-layer filler inside, Although it has a protrudent shape on its embroidering product, But It is unobvious in view of the sight seeing of the solid level.

SUMMARY OF THE PRESENT INVENTION

It is thus a main object of the present invention to provide a process and configuration of multilayer protruding embroidery which is adequate for mass producing identical protruding embroidery products.

Another object of the present invention is to provide a process and configuration of multilayer protruding embroidery which can provide an obvious solid level in view of the sight seeing for the mass protruding embroidery.

Accordingly, the present invention provides a multilayer protruding embroidery process which comprises the following steps:

By means of the above disclosed process, a configuration of multilayer protruding embroidery is manufactured, which comprises an embroidering background element having a figure portion; a first filler which has a predetermined embroidering figure and is attached on the background element to cover the figure portion of the embroidering background element; a plurality of a first sewing threads enwrapping around the embroidering figure of the first filler and the figure portion of the embroidering background element; a second filler which has a predetermined embroidering figure and is attached on the first filler; and a plurality of a second sewing threads enwrapping around the embroidering figure of the second filler, the first filler and the figure portion of the embroidering background element to form a multilayer protruding embroidery.

DETAILED DESCRIPTION OF THE PREFERRED EMBODIMENT

Figure 1:
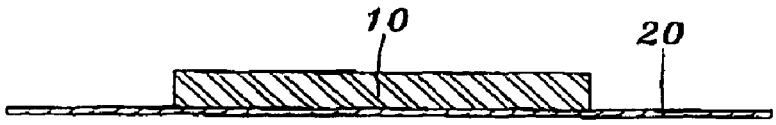
FIG. 1 is a sectional end view of a preferred embodiment in accordance with the present invention, illustrating a first filler laid on an embroidering background element.

Referring to FIGS. 1 to 7, a multilayer protruding embroidery process according to a preferred embodiment of the present invention, which comprises the following steps:

(a) As shown in FIG. 1, lay and affix a first filler 10 by adhering or sewing on an embroidering background element 20, in which the first filler 10 has an even thickness and a size larger than a contour size of a desired embroidering figure for covering a figure portion on the embroidering background element 20 where the desired embroidering figure is required to embroider thereon.

Figure 2:
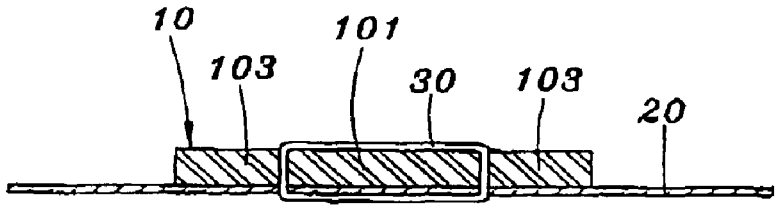
FIG. 2 is a sectional end view of the above preferred embodiment in accordance with the Present invention, illustrating the embroidering of the first filler and the embroidering background element.

(b) As shown in FIG. 2, entirely wrap up a first embroidering portion 103 of the first filler 10 and the embroidering background element 20 with a plurality of a first sewing threads 30 until the whole first embroidering portion 101, including a predetermined number of side edges thereof is entirely covered and wrapped up by the first sewing threads 30.

Figure 3:
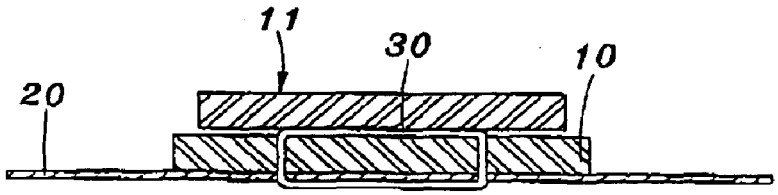
FIG. 3 is a sectional end view of the above preferred embodiment in accordance with the Present invention, illustrating a second filler laid on the first filler.

(c) As shown in FIG. 3, lay and affix a second filler 11 by adhering or sewing on the first filler 10, in which the second filler 11 has an even thickness and a size larger than a contour size of a desired embroidering figure for covering the figure portion on the second filler 11 where the desired embroidering figure is required to embroider thereon.

Figure 4:
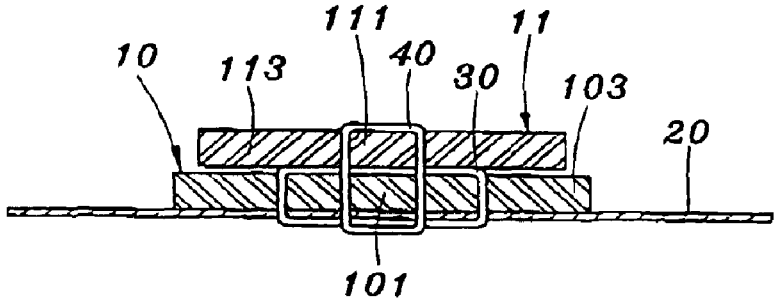
FIG. 4 is a sectional end view of the above preferred embodiment in accordance with the Present invention, illustrating the embroidering of the first filler, the second filler and the embroidering background element.

(d) As shown in FIG. 4, entirely wrap up a second embroidering portion 113 of the second filler 11, the whole first embroidering portion 101 of the first filler 10 and the embroidering background element 20 with a plurality of a second sewing threads 40 until the whole embroidering portion 111 of the second filler 11, including a predetermined number of side edges thereof is entirely covered and wrapped up by the second sewing threads 40.

Figure 5:
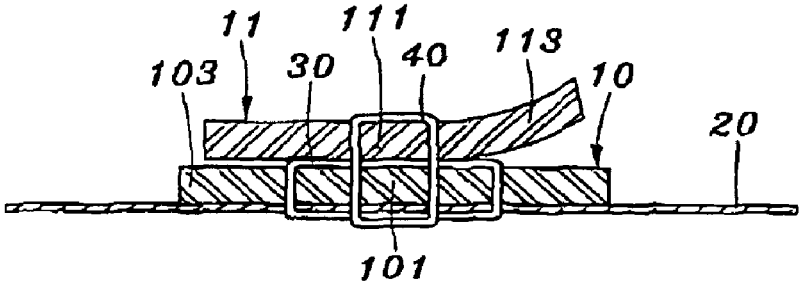
FIG. 5 is a sectional end view of the above preferred embodiment in accordance with the Present invention, the removing leftover of the second filler from the side periphery of a multilayer protruding embroidery.
Figure 6:
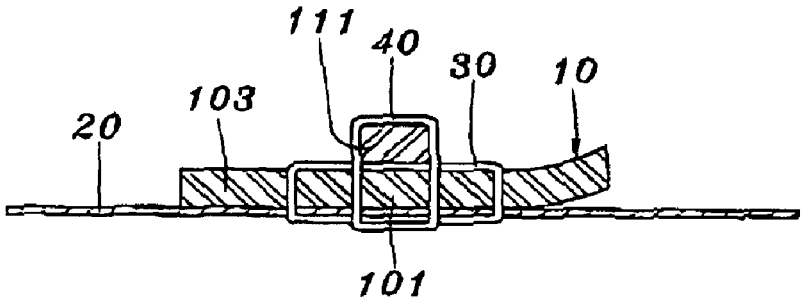
FIG. 6 is a sectional end view of the above preferred embodiment in accordance with the Present invention, the removing leftover of the first filler from the side periphery of the multilayer protruding embroidery.
Figure 7:
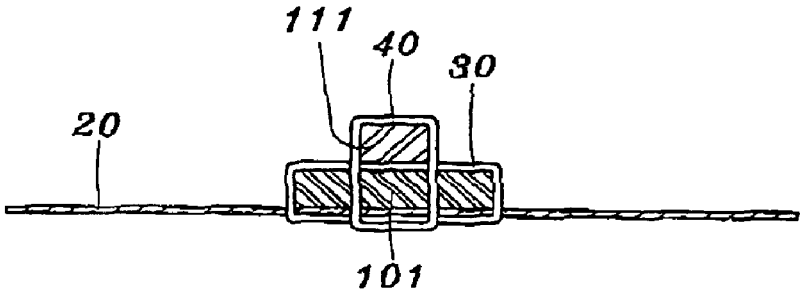
FIG. 7 is a sectional end view of the multilayer protruding embroider manufactured by means of the process of the above preferred embodiment of the present invention.

(e) As shown in FIG. 5 and FIG. 6, fully cut off and remove the leftover of the second embroidering portion 113 and first embroidering portion 103 respectively, wherein said second embroidering portion 113 is an outer portion of the second filler 11 surrounding the embroidering portion 111, from the embroidering portion 111. Said first embroidering portion 103 is an outer portion of the first filler 10 surrounding the embroidering portion 101, from the embroidering portion 101 and thus, a size of the whole first embroidering portion 101 and whole second embroidering portion 111 are the same as the desired embroidering figure and formed with a multilayer protruding embroidery, as shown in FIG. 7.

In accordance with the above preferred embodiment the multilayer protruding embroidery process is preferred to proceed with a numerical control (NC) embroidery machine as of conventional. The conventional NC embroidery machine generally comprises a plurality of lined up embroidery units for processing identical embroideries on several embroidering background elements respectively at one time. Each embroidery unit has an operating table surface and several needles positioned perpendicularly to the operating table surface. The needles are all threaded with threads in difference colors respectively and are preferred to be made of wear-resisting steel.

The contour of a figure which is required to embroider on the both or silk embroidering background element is input into the computer of the embroidery machine for formatting, so that the paths and the number of the needle perforating during embroidering will be calculated as numerical data. Such numerical data will be transmitted to the embroidery machine to operate the embroidering of general flat surface embroidery. Actually, the movement of the operating table in longitudinal and transversal directions.

In step (a), as shown in FIG. 1, the cloth or silk embroidering background elements are placed in position on the embroidery table surfaces of the embroidery units of the embroidery machine respectively. The first filler 10 is laid on the embroidering background element 20 in a position desired to proceed multilayer protruding embroidery figure. The first filler 10 can be adhered by tape or sewed to affix on the embroidering background element 20 (just few stitches to make sure the first filler 10 is affixed in position).

As a result had shown in FIG. 1, the whole second embroidering portion 111 which is entirely covered and wrapped up by the second sewing threads 40 can be configured in a number of attractive shapes, such as a flower, and thus the whole first embroidering portion 101 can be as a leaf, Both of said shapes of flower and leaf are provide an very obvious sight seeing for solid level effect than a conventional protruding embroidery.

It is worth to disclose that the collapse of the corners or edges of the multilayer protruding embroidery figure, which may frequently happen in the conventional protruding embroidery, can be prevented when the protruding embroidery process of the present invention is utilized.

By means of the above process disclosed in the above preferred embodiment, a configuration of multilayer protruding embroidery is produced, as shown in FIG. 7, which comprises:

An embroidering background element 20;

A first filler 10 which has a predetermined embroidering figure being attached on the embroidering background element 20;

A plurality of a first sewing threads 30 enwrapping around the embroidering figure of the first filler 10 and the embroidering background element 20, wherein the first filler 10 including a predetermined number of side edges thereof is entirely covered and wrapped up the first sewing threads 30 to form a first layer protruding embroidery;

A second filler 11 which has a predetermined embroidering figure being attached on the first filler 10; and A plurality of a second sewing threads 40 enwrapping around the embroidering figure of the second filler 11 the first filler 10 and the embroidering background element 20, wherein the second filler 11 including a predetermined number of side edges thereof is entirely covered and wrapped up the second sewing threads 40 to form a second layer protruding embroidery.

What is claimed is:

1. A multilayer protruding embroidery process, comprising the steps of:

(a) laying and affixing a first filler on an embroidering background element, in which said first filler has an even thickness and a size larger than a contour size of a desired embroidering figure for covering a figure portion on said embroidering background element where a desired embroidering figure is required to embroider;

(b) entirely wrapping up a first embroidering portion of said first filler and said embroidering background element with a plurality of a first sewing threads until the whole first embroidering portion, including a predetermined number of side edges thereof, is entirely covered and wrapped up by said first sewing threads;

(c) laying and affixing a second filler on the first filler, in which said second filler has an even thickness and a size larger than a contour size of a desired embroidering figure for covering the figure portion on said second filler where the desired embroidering figure is required to embroider, (d) entirely wrapping up a second embroidering portion of said second filler, the whole first embroidering portion of said first filler and said embroidering background element with a plurality of a second sewing threads until the whole second embroidering portion, including a predetermined number of side edges thereof, is entirely covered and wrapped up by said second sewing threads; and (e) fully cutting off and removing the leftover of the second embroidering portion and first embroidering portion respectively, wherein said second embroidering portion is an outer portion of said second filler surrounding said embroidering portion, from said embroidering portion, and said first embroidering portion is an outer portion of said first filler surrounding said embroidering portion, from said embroidering portion, and thus, a size of the whole first embroidering portion and whole second embroidering portion are the same as the desired embroidering figure and formed with a multilayer protruding embroidery.

2. A multilayer protruding embroidery process, as recited in claim 1, wherein, in step (a), said first filler is adhered by tape on said embroidering background element.

3. A multilayer protruding embroidery process, as recited in claim 1, wherein, in step (a), said first filler is sewed by a few stitches to affix on said embroidering background element.

4. A multilayer protruding embroidery process, as recited in claim 1, wherein, in step (c), said second filler is adhered by tape on said embroidering background element.

5. A multilayer protruding embroidery process, as recited in claim 1, wherein, in step (c), said second filler is sewed by a few stitches to affix on said embroidering background element.

6. A multilayer protruding embroidery, comprising:

an embroidering background element having a figure portion;

a first filler having a predetermined embroidering figure and being attached on said background element to cover said figure portion of said embroidering background element;

a plurality of first sewing threads enwrapping around said embroidering figure of said first filler and said figure portion of said embroidering background element, wherein said first filler including a predetermined number of side edges thereof is entirely covered and wrapped up said first sewing threads to form a first layer protruding embroidery;

a second filler having a predetermined embroidering figure being attached on the first filler; and a plurality of a second sewing threads enwrapping around the embroidering figure of the second filler, the first filler and the embroidering background element, wherein said second filler including a predetermined number of side edges thereof is entirely covered and wrapped up said second sewing threads to form a second layer protruding embroidery.

* * * * *